United States Patent [19]

Döring et al.

[11] Patent Number: 4,735,077

[45] Date of Patent: Apr. 5, 1988

[54] METHOD OF AND DEVICE FOR IMPRESSING CHANNELS HAVING A SMALL CROSS-SECTIONAL AREA INTO THE SURFACE OF AN OBJECT

[75] Inventors: Michael Döring; Peter Wohlenberg, both of Hamburg, Fed. Rep. of Germany

[73] Assignee: U.S. Philips Corporation, New York, N.Y.

[21] Appl. No.: 889,725

[22] Filed: Jul. 28, 1986

[30] Foreign Application Priority Data

Aug. 9, 1985 [DE] Fed. Rep. of Germany ..... 3528642

[51] Int. Cl.[4] ..... B21D 22/10

[52] U.S. Cl. ..... 72/379; 72/465; 72/471

[58] Field of Search ..... 72/379, 471, 473, 481, 72/482, 184, 430, 465; 101/3 R, 28

[56] References Cited

U.S. PATENT DOCUMENTS 2,765,682 10/1956 Wiley ..... 72/80
4,612,765 9/1986 Livesay ..... 72/465
4,612,795 9/1986 Yoshiga ..... 72/478

*Primary Examiner*—Lowell A. Larson
*Attorney, Agent, or Firm*—Robert T. Mayer

[57] ABSTRACT

The invention relates to a method of impressing channels having a cross-sectional area of less than 1 mm$^2$, notably less than 3000 $\mu$m$^2$, into the surface of an object, notably for the formation of damping channels of ink jet printer heads. The impression of channels having a small cross-sectional area can be performed with high precision by inserting a wire-shaped element (5) between the surfaces of the object (2) and of a plane die (1) in the position of the channel (3, 4, 12) to be formed, after which the die (1) is pressed until it contacts the surface of the object (2).

7 Claims, 1 Drawing Sheet

Fig.1
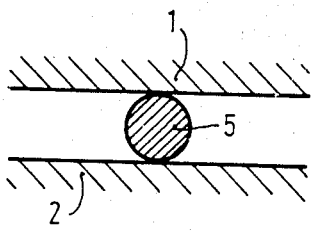
Fig.3
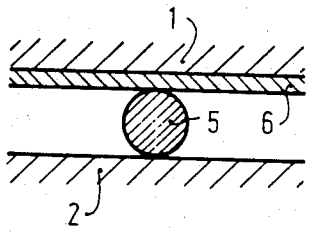
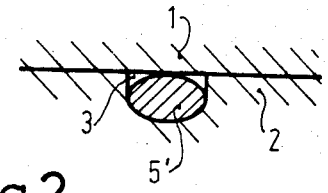
Fig.2
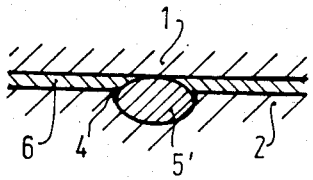
Fig.4
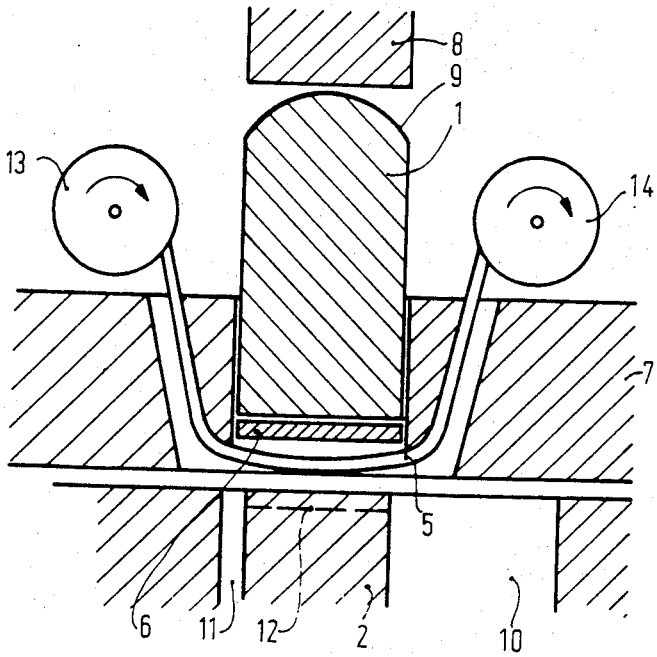
Fig.5

METHOD OF AND DEVICE FOR IMPRESSING CHANNELS HAVING A SMALL CROSS-SECTIONAL AREA INTO THE SURFACE OF AN OBJECT

The invention relates to a method of impressing channels having a cross-sectional area of less than 1 $mm^2$ into the surface of an object.

Channels having such small cross-sectional areas are used notably for ink jet printer heads operating according to the Drop-On-Demand method. Therein, droplets are ejected from nozzles in reaction to a pressure surge in a fluid system. The amount of energy introduced into the fluid is far greater than required for the formation of a droplet. After the ejection of the droplet, the residual energy must be dissipated from the fluid generally, this is realized by damping the fluid oscillation in a suitable damping capillary. In order to achieve optimum damping, the cross-section of the damping capillaries must be very accurately adapted to the viscosity of the ink and the frequency of the fluid oscillation. For the viscosities and oscillation frequencies occurring in ink jet printer heads, the cross-sectional areas required for damping are between 1000 and 3000 $\mu m^2$; these values must be realized with a tolerance of apprroximately + or −100 $\mu m^2$.

Thus far the damping capillaries were constructed by impressing channels into a high-quality steel plate by means of a complex tool. A die manufactured with the utmost of precision was pressed into the steel plate and it was necessary to control the depth of impression very accurately by means of complex measurement means because of possible damage or wear of the pressing tool. The object and the pressing die also had to be very accurately aligned in order to ensure a uniform depth over the entire length of the damping channel. The tool and the manufacturing process were complex and the tool could operate for a short time only.

It is an object of the invention to improve the method of the kind set forth so that channels having a small cross-sectional area can be impressed with high precision by means of simple means without substantial control being required.

This object is achieved in that between the surfaces of the object and of a plane die a wire-shaped element is arranged in the position of the channel to be formed, after which the die is pressed until it contacts the surface of the object.

Instead of a complex pressing die, use is now made of a simple, commercially available wire which can be manufactured with high precision and which must, of course, be harder than the object (for example, a tungsten wire). The wire is arranged on the object at the area where the channel is to be impressed. Using a plane hard-metal plate, the wire is pressed into the object. When the hard-metal plate bears on the object, the wire cannot be pressed further, so that the pressing operation ceases.

Wire-shaped elements having a circular cross-section can be particularly simply and accurately manufactured.

Because of the elastic and/or plastic deformation during the pressing operation, the diameter of the wire-shaped element is preferably choosen so as to be smaller than the width of the channel.

During the pressing operation the wire is in any case elastically deformed, so that the bottom of the damping duct will have an elliptical shape. This is not decisive for the operation, but offers the advantage that the wire springs back slightly when the hard-metal plate is raised again, so that it can be very simply removed.

Different cross-sectional areas of channels can be realized by means of the same wire-shaped element when a soft, deformable foil is inserted between the die and the wire-shaped element. The foil is preferably made of plastics. During the pressing operation, the wire is pressed into the foil which is plastically deformed and destroyed. Plastics foils of different thickness can be very accurately manufactured and are commercially available.

Because of the plastic deformability of the wire-shaped element, a fresh length of a wire-shaped element is preferably used for each pressing operation.

A particularly effective device for performing the method in accordance with the invention is characterized in that it includes a feed reel for a fresh wire-shaped element and a take-up reel for used lengths of the wire-shaped element, said reels being opposite situated in the channel direction on both sides of the die, the take-up reel being intermittently rotatable by means of a drive device which is controlled so that after each pressing operation a length of the wire-shaped element is taken up which is longer than the length used for the pressing operation. Using a device of this kind a succession of channels can be simply impressed into an object or similar channels can be impressed into a plurality of objects.

The intermediate foils can be fed in a similar manner.

Total contact between the die and the surface of the object is ensured without elaborate alignment when the die is driven via a spherical surface and guided so as to be pivotable to all sides by a given amount.

The method in accordance with the invention enables the formation of not only straight but also curved channels, which was impossible thus far by means of simple dies. The channel geometry can also be very simply changed without modification of the tool.

The invention will be described in detail hereinafter with reference to the accompanying drawing.

FIGS. 1 and 2 diagrammatically show the start and the finish, respectively, of the impression of a channel in an object in accordance with the invention.

FIGS. 3 and 4 diagrammatically show a pressing operation which is analogous to that shown in the FIGS. 1 and 2 and which utilizes an intermediate plastics foil.

FIG. 5 illustrates the principle of a preferred device for performing the method in accordance with the invention.

In the FIGS. 1 to 4 only the end portion of a hard-metal die 1 is visible; this portion has a smooth, preferably polished surface. The reference numeral 2 each time denotes the area of an object in which a channel 3 or 4 is to be impressed.

In FIG. 1, a wire 5 is inserted between the die 1 and the object 2 directly before the start of the pressing operation. The material and the hardness of the wire 5 should be adapted to the material of the object 2. It has been found that tungsten wires are attractive for impressing channels into steel.

After the hard die 1 has been pressed against the surface of the softer work piece 2, the elliptically deformed wire 5' has been pressed into the material of the object 2, as appears from FIG. 2, thus forming the channel 3. The deformation of the circular wire 5 into the elliptical shape is elastic and usually also plastic. The elastic deformation offers the advantage that, after the raising of the die 1, the original cross-sectional shape is approached to a given extent again, so that the spent wire can be simply removed from the channel. However, because in most cases plastic deformation also occurs, a length of wire can be used only once.

For proportioning the wire diameter as a function of the desired channel width, it must be taken into account that the width of the channel 3 will generally be greater than the diameter of the wire 5.

In the FIGS. 3 and 4 an additional plastics foil 6 is arranged between the surface of the die 1 and the wire 5. During the pressing operation, the thin wire 5 is pressed through the comparatively soft foil 6 until it contacts the surface of the die 1. Because the foil is not compressed at the other areas, a distance corresponding to the thickness of the foil will ultimately remain between the die 1 and the object 2 as shown in FIG. 4. The depth of the channel 4 of FIG. 4 is smaller than that of the channel 3 of FIG. 2 by an amount corresponding to this distance.

Thus, by the insertion of foils 6 of different thickness the depth of the channel 4 can be deliberately varied even when using a constant diameter of the wire 5. Moreover, the insertion of a foil 6 offers the advantage that the pressure of the wire 5 is distributed across a larger surface of the die 1. As a result of the reduced surface pressure, the life of the die 1 is substantially increased.

Using a tungsten wire having a diameter of 42 μm, experiments were performed with foils of polyethylene terephthalate having a different thickness d. Each time the width b and the depth t of the impressed channel 4 were measured. Characteristic measurement values are given in μm in the following table:

| d | b | t |
|---|---|---|
| 6 | 54 | 28 |
| 8 | 54 | 26 |
| 10 | 52 | 24 |

It appears that the sum of the depth t of the channel 4 and the thickness d of the foil 5 is constant. It is to be noted that the width b of the channel 4 also becomes smaller in the case of thicker foils (in the example for $d>8$ μm). Because it cannot be established accurately enough in theory how large the cross-sectional area of the channel will be for given diameter of the wire 5 and thickness d of the foil 6, optimum values must be found by experiments.

The surface of the die acting on the wire 5 was flat and polished. It has been found that no grooves for guiding the wire 5 may be recessed into the surface of the die, because edges may then arise at the sides of the channels 3 or 4 which project beyond the surface of the object. For example, the smooth fitting of a cover plate for closing the open sides of the channels will then be more difficult.

Because absolutely accurate positioning of the channels is not necessary for the formation of damping channels for ink jet printer heads, whilst the channel cross-sectional areas must be maintained with very narrow tolerances, a wire feed which varies within a given range is readily permissible between the die and the object.

For experiments and for the working of limited numbers of objects lengths of wire can be inserted by hand. For series production, however, the use of a device as shown in FIG. 5 is advantageous; therein, fresh wire 5 and foil 6 are automatically fed from feed reels.

The die 1 is guided with a clearance in a guide plate 7 and is driven by the plunger 8 via its spherical surface 9, so that the surface of the die 1 which acts on the wire can adapt itself to a given extent to different positions of the object surface. The object 2 is to be provided with a channel which extends between the cavities 10 and 11, the depth of the channel being indicated by the broken line 12; this channel must have a cross-sectional area from approximately 1000 to 3000 $\mu m^2$ when it concerns a damping channel of ink jet printer heads. After each pressing operation, the wire 5 is automatically unwound from a feed reel 13 by a take-up reel 14 so that a fresh length of wire 5 is situated underneath the die. Similarly be it perpendicularly to the unwinding direction of the wire 5 in the embodiment shown in FIG. 5, a fresh length of foil 6 is each time pulled between the die 1 and the wire 5.

Using a device as shown in FIG. 5, channels can be successively impressed in a series of similar objects. It is also possible to impress a plurality of identical channels in a single object by suitably changing the relative position of the object with respect to the pressing tool.

What is claimed is:

1. A method of impressing a prescribed channel having a cross-sectional area of less than 1 $mm^2$ into a substantially plane surface of an object, characterized in that between the surfaces of the object (2) and of a plane die (1) a wire-shaped element (5) is arranged in the position of the channel (3, 4, 12) to be formed, and a soft deformable foil material of a thickness preselected to control the depth of the channel to be formed is inserted between the plane die and the wire-shaped element after which the die (1) is pressed until the presecribed channel is formed.

2. A method as claimed in claim 1, characterized in that the wire-shaped element (5) has a circular cross-section.

3. A method as claimed in claim 2, characterized in that the diameter of the wire-shaped element (5) is smaller than the width of the channel (3, 4, 12).

4. A method as claimed in claim 3, characterized in that the foil (6) is made of plastics.

5. A method as claimed in any one of the claims 1, 2, 3, or 4, characterized in that a fresh length of a wire-shaped element (5) is used for each pressing operation.

6. A device for performing the method claimed in claim 5, characterized in that it includes a feed reel (13) for a fresh wire-shaped element (5) and a take-up reel (14) for used lengths of the wire-shaped element (5), said reels being oppositely situated in the channel direction on both sides of the die (1), the take-up reel (14) being intermittently rotatable by means of a drive device which is controlled so that after each pressing operation a length of the wire-shaped element (5) is taken up which is longer than the length used for the pressing operation and in that it includes a feed reel of a fresh foil tape (6) and a take-up reel for used lengths of foil tape, said reels being oppositely situated on both sides of the die, said foil tape being of a soft deformable material of a thickness preselected to control the depth of the channel to be formed, the take-up reel being intermittently rotatable by means of a drive device which is controlled so that after each pressing operation a length of a foil tape is taken up which is longer than the length used for the pressing operation.

7. A device as claimed in claim 6, characterized in that the die (1) is driven by a spherical surface (9) and guided so as to be pivotable to all sides by a given amount.

* * * * *